US008705999B2

(12) United States Patent
Okabe et al.

(10) Patent No.: US 8,705,999 B2
(45) Date of Patent: Apr. 22, 2014

(54) IMAGE FORMING DEVICE INCLUDING SUPPORTING MEMBER FOR SUPPORTING PHOTOSENSITIVE DRUMS

(75) Inventors: Yasushi Okabe, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 155 days.

(21) Appl. No.: 13/310,994

(22) Filed: Dec. 5, 2011

(65) Prior Publication Data

US 2012/0148288 A1 Jun. 14, 2012

(30) Foreign Application Priority Data

Dec. 8, 2010 (JP) ..... 2010-273827

(51) Int. Cl.
*G03G 15/00* (2006.01)

(52) U.S. Cl.
USPC ..... 399/90; 399/110

(58) Field of Classification Search
USPC ..... 399/90, 110
See application file for complete search history.

(56) References Cited

U.S. PATENT DOCUMENTS

| | | | | |
|---|---|---|---|---|
| 5,444,523 | A | 8/1995 | Sameshima et al. | |
| 6,029,019 | A | 2/2000 | Kawai | |
| 6,198,891 | B1 * | 3/2001 | Ishida et al. | 399/117 |
| 7,769,318 | B2 * | 8/2010 | Okabe | 399/110 |
| 7,773,905 | B2 | 8/2010 | Kuruma | |
| 7,991,323 | B2 | 8/2011 | Hashimoto | |
| 8,126,352 | B2 * | 2/2012 | Ishikawa et al. | 399/90 |
| 2008/0226347 | A1 | 9/2008 | Nagai | |
| 2008/0279579 | A1 | 11/2008 | Kuruma | |
| 2009/0220274 | A1 | 9/2009 | Hashimoto | |
| 2010/0135697 | A1 | 6/2010 | Hashimoto | |
| 2010/0239306 | A1 | 9/2010 | Souda | |
| 2011/0299874 | A1 * | 12/2011 | Fujiwara | 399/90 |

FOREIGN PATENT DOCUMENTS

| | | | | |
|---|---|---|---|---|
| JP | 5-303984 | A | 11/1993 | |
| JP | 6-258881 | A | 9/1994 | |
| JP | 3003453 | U | 10/1994 | |
| JP | 7-084499 | A | 3/1995 | |
| JP | 10-301350 | A | 11/1998 | |
| JP | 2000-247472 | | 9/2000 | |
| JP | 2001-063178 | A | 3/2001 | |
| JP | 2001-343881 | A | 12/2001 | |
| JP | 2001343881 | A * | 12/2001 | G03G 21/16 |

(Continued)

OTHER PUBLICATIONS

Machine translation of JP 2001-343881 to Tateisha.*

*Primary Examiner* — G. M. Hyder
(74) *Attorney, Agent, or Firm* — Banner & Witcoff, Ltd.

(57) ABSTRACT

An image forming device includes a main body, a grounding member, and a supporting member. The supporting member is slidably movable between a mounting position and a drawn-out position with respect to the main body. The supporting member includes a plurality of photosensitive drums, a pair of side plates, a contact portion, and a connecting portion. The pair of side plates supports each photosensitive drum. At least one side plate is electrically connected to the grounding member when the supporting member is disposed at the mounting position. A user contacts the contact portion when drawing the supporting member to move from the mounting position. The contact portion and the at least one side plate are electrically connected with each other via the connecting portion. Each of the pair of side plates, contact portion, and connecting portion is made of an electrically conductive material.

34 Claims, 10 Drawing Sheets

(56) References Cited

FOREIGN PATENT DOCUMENTS

| | | | |
|---|---|---|---|
| JP | 2004-138775 | A | 5/2004 |
| JP | 2008-225344 | A | 9/2008 |
| JP | 2008-276117 | A | 11/2008 |
| JP | 2009-210629 | A | 9/2009 |
| JP | 2010-128340 | | 6/2010 |
| JP | 2010-217531 | A | 9/2010 |
| JP | 2010-224117 | A | 10/2010 |

* cited by examiner

IMAGE FORMING DEVICE INCLUDING SUPPORTING MEMBER FOR SUPPORTING PHOTOSENSITIVE DRUMS

CROSS REFERENCE TO RELATED APPLICATION

This application claims priority from Japanese Patent Application No. 2010-273827 filed Dec. 8, 2010. The entire content of the priority application is incorporated herein by reference.

TECHNICAL FIELD

The present invention relates to an image forming device.

BACKGROUND

There has been provided a tandem-type electrophotographic color printer that includes a plurality of photosensitive drums corresponding to colors of yellow, magenta, cyan, and black and juxtaposed with each other.

In one type of such tandem-type color printers, a drum unit in which a pair of inner side plates and four photosensitive drums are provide is slidably movable relative to a main casing. The pair of inner side plates is made of metal, and arranged in confrontation with and spaced apart from each other. The four photosensitive drums are rotatably supported to the pair of inner side plates via flange members.

The photosensitive drum includes a drum body, a metal grounding member, a metal shaft, and a metal clip member. The grounding member is fitted into the drum body so as to contact an inner surface of the drum body. The shaft has one end electrically connected to the grounding member, and another end penetrating the flange member to protrude outward from the flange member. The clip member serves to electrically connect the other end of the shaft to the inner side plate. The drum body is grounded via the grounding member, the shaft, and the clip member.

When the drum unit is accommodated in the main casing, the inner side plates are brought into abutment with a metal reference shaft provided in the main casing. The drum body is grounded to the main casing via the grounding member, the shaft, the clip member, the inner side plates, and the reference shaft.

SUMMARY

With this configuration, the inner side plates are in abutment with the reference shaft when the drum unit is accommodated in the main casing. However, when the drum unit is drawn outward from the main casing, the inner side plates are separated from the reference shaft. Hence, the drum body is ungrounded relative to the main casing.

When generating a difference in electric potential between the drum unit that is drawn outward from the main casing and the user that draws the drum unit from the main casing, electrical discharge between the drum unit and the user are caused by static electricity accumulated in the drum unit, which may repel the user.

In view of the foregoing, it is an object of the present invention to provide an image forming device capable of restraining electrostatic discharge between a support member for supporting a photosensitive drum and a user.

In order to attain the above and other objects, the present invention provides an image forming device including a main body, a grounding member, and a supporting member. The supporting member is slidably movable between a mounting position and a drawn-out position with respect to the main body. The supporting member includes a plurality of photosensitive drums, a pair of side plates, a contact portion, and a connecting portion. The grounding member is electrically grounded. The plurality of photosensitive drums are juxtaposed with and spaced apart from each other. Each of the plurality of photosensitive drums extends in an axial direction and has two ends in the axial direction. The pair of side plates is arranged in confrontation with and spaced apart from each other. The pair of side plates is made of an electrically conductive material. The pair of side plates supports the two ends of each of the plurality of photosensitive drums. At least one of the pair of side plates is electrically connected to the grounding member when the supporting member is disposed at the mounting position. A user contacts to the contact portion when the user draws the supporting member to move from the mounting position to the drawn-out position. The contact portion is made of an electrically conductive material. The contact portion and the at least one of the pair of side plates are electrically connected with each other via the connecting portion. The connecting portion is made of an electrically conductive material. The drawn position is a position in which the supporting member is drawn outward from the main body so that the photosensitive drums can be replaced. The mounting position is a position in which the supporting member is accommodated in and mounted to the main body so that the photosensitive drums can be operated to forming images.

According to another aspect, the present invention provides an image forming device including a main body, a grounding member that is electrically grounded; and, a supporting member. The supporting member is slidably movable between a mounting position and a drawn-out position with respect to the main body. The supporting member includes a side plate, a contact portion, and a connecting portion. The side plate is made of an electrically conductive material. The side plate supports a photosensitive drum. The side plate is electrically connected to the grounding member when the supporting member is disposed at the mounting position. A user contacts to the contact portion when the user draws the supporting member to move from the mounting position to the drawn-out position. The contact portion is made of an electrically conductive material. The contact portion and the side plate are electrically connected with each other via the connecting portion. The connecting portion being made of an electrically conductive material.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
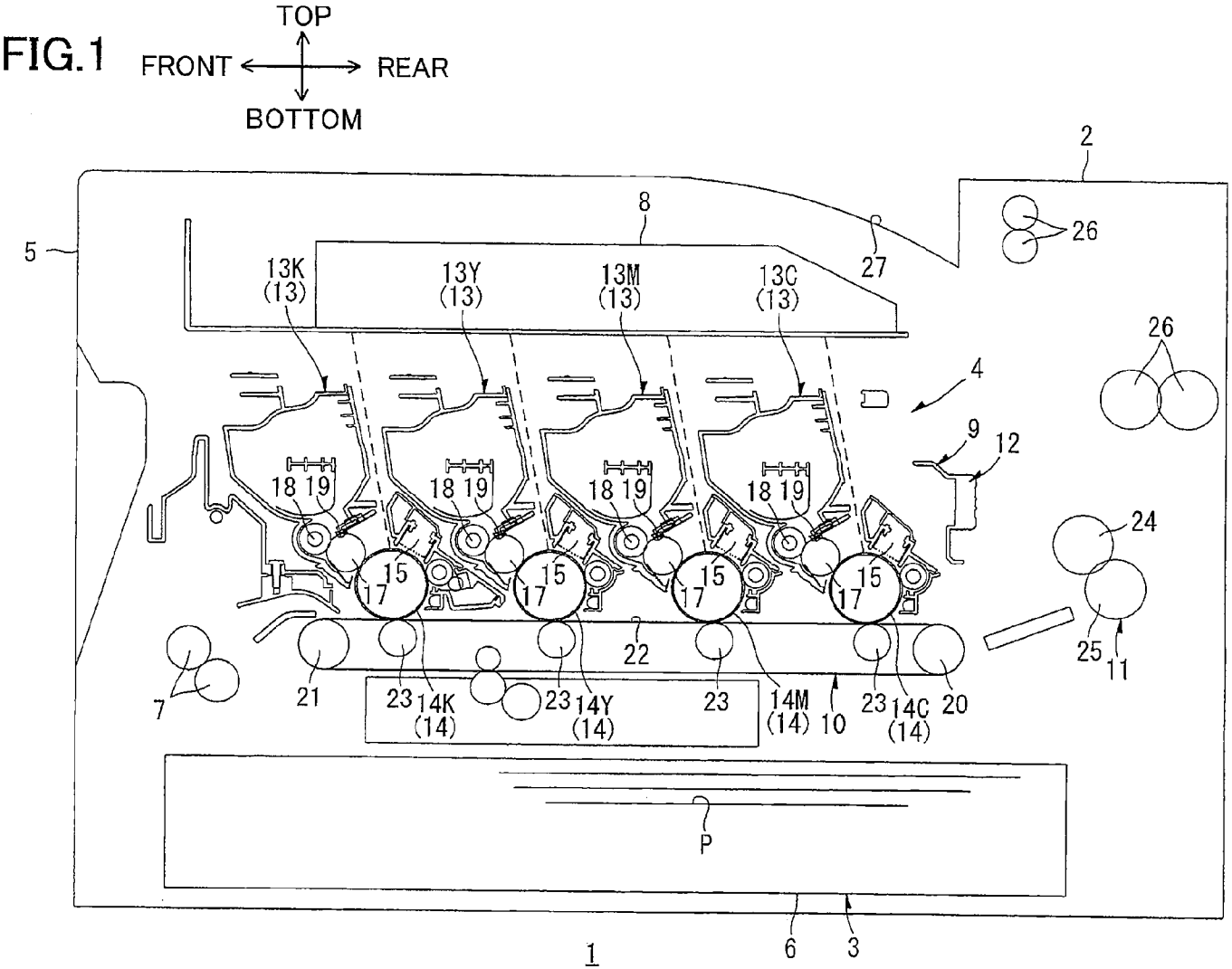
FIG. 1 is a schematic cross-sectional view of a color laser printer as an image forming device according to one embodiment of the present invention.

An image forming device according to one embodiment of the present invention will be described while referring to the accompanying drawings wherein like parts and components are designated by the same reference numerals to avoid duplicating description.

1. Structure of Color Laser Printer

As shown in FIG. 1, the image forming device according to the embodiment is a horizontal direct tandem-type color laser printer 1. The color laser printer 1 includes a main casing 2. Within the main casing 2, a sheet supply unit 3 for supplying a sheet P and an image forming unit 4 for forming an image on the sheet P supplied from the sheet supply unit 3 are provided.

(1) Main Casing

The main casing 2 is formed in a rectangular box shape. The main casing 2 has a front portion at which a front cover 5 is provided. The front cover 5 is pivotally movable about its lower end relative to the main casing 2 to open and close a front opening formed in the front portion of the main casing 2.

The terms "upward", "downward", "upper", "lower", "above", "below", "right", "left", "front", "rear" and the like will be used throughout the description assuming that the color laser printer 1 is disposed in an orientation in which it is intended to be used. In the following description, a side of the color laser printer 1 on which the front cover 5 is provided (left side in FIG. 1) will be referred to as a front side of the color laser printer 1. Left and right sides of the color laser printer 1 in the following description will be based on the reference point of a user viewing the color laser printer 1 from the front side. More specifically, in FIG. 1, a near side and a far side are a right side and a left side, respectively.

(2) Sheet Supply Unit

The sheet supply unit 3 includes a sheet supply tray 6 which is disposed in a lower section of the main casing 2 for accommodating the sheets P. The color laser printer 1 also includes a pair of registration rollers 7 disposed above a front end of the sheet supply tray 6.

Each sheet P accommodated in the sheet supply tray 6 is supplied to a position between the registration rollers 7, and further to the image forming unit 4 (more precisely to a position between a photosensitive drum 14 (described later) and a conveying belt 22 (described later)) at a predetermined timing.

(3) Image Forming Unit

The image forming unit 4 includes a scanner unit 8, a process unit 9, a transfer unit 10, and a fixing unit 11.

(3-1) Scanner Unit

The scanner unit 8 is disposed at an upper section of the main casing 2. Based on image data, the scanner unit 8 irradiates laser beams to expose four photosensitive drums 14 (described later) as indicated by broken lines shown in FIG. 1.

(3-2) Process Unit (3-2-1) Structure of Process Unit

The process unit 9 is disposed below the scanner unit 8 and above the transfer unit 10. The process unit 9 includes a process frame 12 and four developing cartridges 13 corresponding to each color. The process unit 9 is slidably movable in a front-to-rear direction between a mounting position (FIG. 6) in which the process unit 9 is accommodated in the main casing 2 and capable of forming an image, and a drawn-out position (FIG. 9) in which the process unit 9 is drawn outward from the main casing 2 so that the photosensitive drums 14 can be replaced. The process unit 9 is accommodated in and drawn outward from the main casing through the front cover 5.

The process frame 12 is disposed so as to be slidably movable in the front-to-rear direction with respect to the main casing 2. The process frame 12 supports the four photosensitive drums 14 and four Scorotron chargers 15.

The four photosensitive drums 14 are juxtaposed with each other in the front-to-rear direction at fixed intervals such that each photosensitive drum 14 extends in a right-to-left direction. More specifically, the photosensitive drums 14 include a black photosensitive drum 14K, a yellow photosensitive drum 14Y, a magenta photosensitive drum 14M, and a cyan photosensitive drum 14C in the order from front to rear.

Each of the chargers 15 is disposed at a position diagonally above and rearward of the corresponding photosensitive drum 14 so as to confront the photosensitive drum 14 with a gap therebetween.

The four developing cartridges 13 have a one-on-one correspondence to the four photosensitive drums 14. Each of the developing cartridges 13 is disposed above the corresponding photosensitive drum 14, and detachably supported to the process frame 12. More specifically, the developing cartridges 13 include a black developing cartridge 13K, a yellow developing cartridge 13Y, a magenta developing cartridge 13M, and a cyan developing cartridge 13C in the order from front to rear. Each developing cartridge 13 includes a developing roller 17.

As will be described later, the developing roller 17 is rotatably supported at the bottom of the developing cartridge 13 such that a rear portion of the developing roller 17 is exposed outside the developing cartridge 13 and contacts an upper front portion of the photosensitive drum 14.

Each developing cartridge 13 further includes a supply roller 18 for supplying toner to the developing roller 17, and a thickness-regulation blade 19 for regulating a thickness of the toner supplied to the developing roller 17. The developing cartridge 13 accommodates toner of each color in a space defined above the supply roller 18 and the thickness-regulation blade 19.

(3-2-2) Developing Operation in Process Unit

The toner accommodated in the developing cartridge 13 is supplied to the supply roller 18 and further to the developing roller 17, and tribocharged to a positive polarity at a position between the supply roller 18 and the developing roller 17.

The toner supplied to the developing roller 17 is formed into a thin layer having a uniform thickness on a surface of the developing roller 17 by the thickness-regulation blade 19 as the developing roller 17 rotates.

A surface of the photosensitive drum 14 is uniformly charged to a positive polarity by the charger 15 in association with rotation of the photosensitive drum 14. Then, the surface is subjected to high speed scan of the laser beam (indicated by the broken line) emitted from the scanner unit 8. As a result, an electrostatic latent image corresponding to an image to be formed on the sheet P is formed on the surface of the photosensitive drum 14.

When the photosensitive drum 14 further rotates, the toner deposited on the developing roller 17 and charged to a positive polarity is selectively supplied to the electrostatic latent image formed on the surface of the photosensitive drum 14, thereby forming a toner image on the surface of the photosensitive drum 14 by a reverse development.

(3-3) Transfer Unit

The transfer unit 10 is disposed above the sheet supply unit 3 and below the process unit 9 in the main casing 2 along the front-to-rear direction. The transfer unit 10 includes a drive roller 20, a driven roller 21, the conveying belt 22, and four transfer rollers 23.

The drive roller 20 and the driven roller 21 are disposed in confrontation with and spaced apart from each other in the front-to-rear direction.

The conveying belt 22 is an endless belt stretched around the drive roller 20 and the driven roller 21 such that a top portion of the conveying belt 22 confronts and contacts the photosensitive drums 14. When the drive roller 20 is driven to rotate, the conveying belt 22 circulates such that the top portion of the conveying belt 22 moves rearward from the front.

Each of the transfer rollers 23 is provided at a position confronting the corresponding photosensitive drum 14, with the top portion of the conveying belt 22 interposed therebetween.

The sheet P supplied from the sheet supply unit 3 to the image forming unit 4 is conveyed rearward by the conveying belt 22 and passes through transfer positions between the photosensitive drums 14 and the conveying belt 22 sequentially. The toner image of each color carried on the photosensitive drum 14 is transferred onto the sheet P while the sheet P is conveyed on the conveying belt 22, thereby forming a color image on the sheet P.

(3-4) Fixing Unit

The fixing unit 11 is disposed rearward of the transfer unit 10. The fixing unit 11 includes a heat roller 24 and a pressure roller 25 confronting the heat roller 24. In the fixing unit 11, the color image transferred onto the sheet P is thermally fixed onto the sheet P by heat and pressure while the sheet P passes through a position between the heat roller 24 and the pressure roller 25.

(4) Discharge of Sheet

The sheet P on which the monochromatic or color image has been fixed is conveyed by discharge rollers 26 through a U-shaped path (not shown) and discharged to a discharge tray 27 formed above the scanner unit 8.

2. Detailed Structure of Process Frame

Figure 2:
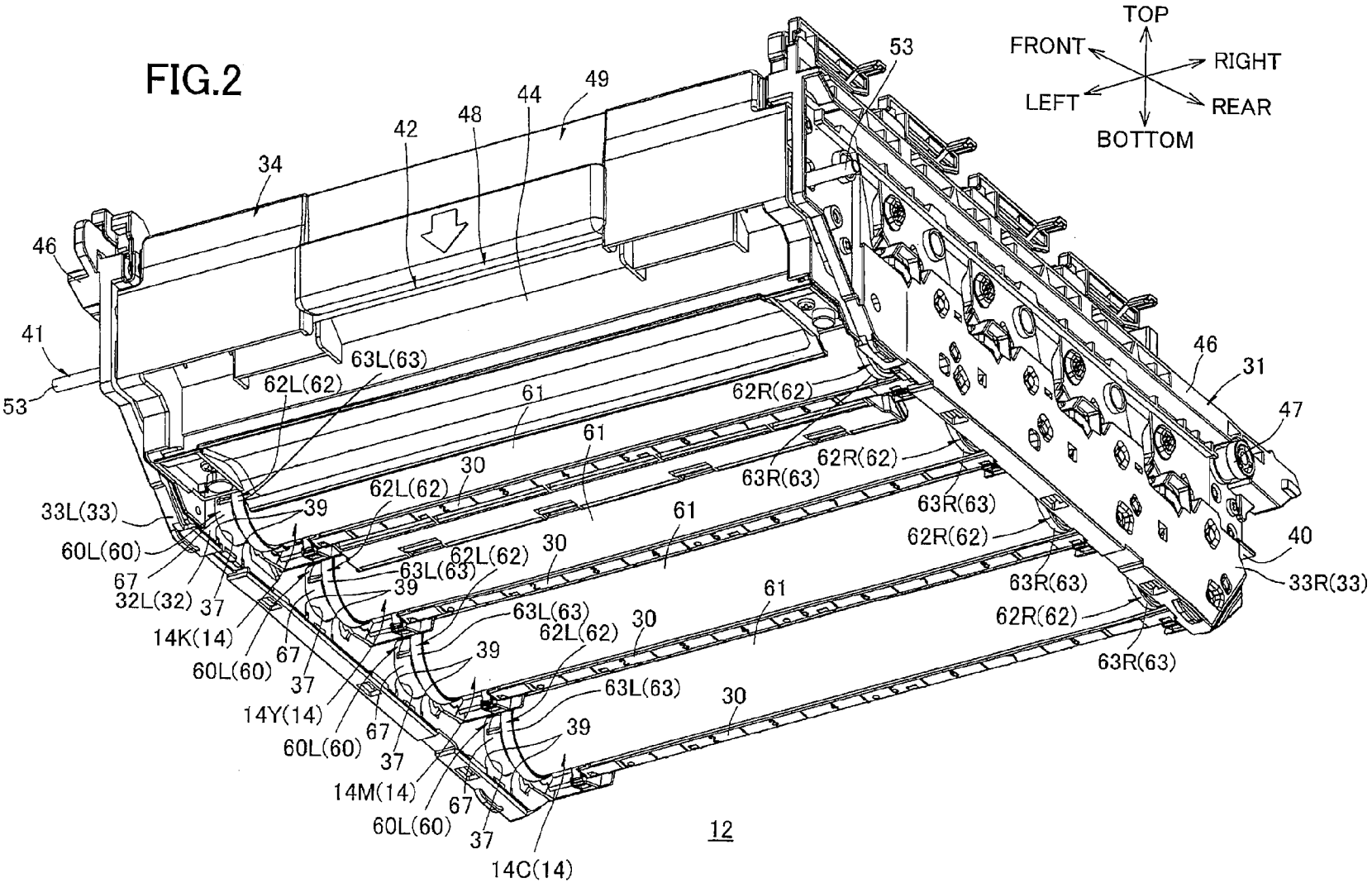
FIG. 2 is a perspective view of a process frame provided in the color laser printer according to the embodiment as viewed from a lower front side.
Figure 3:
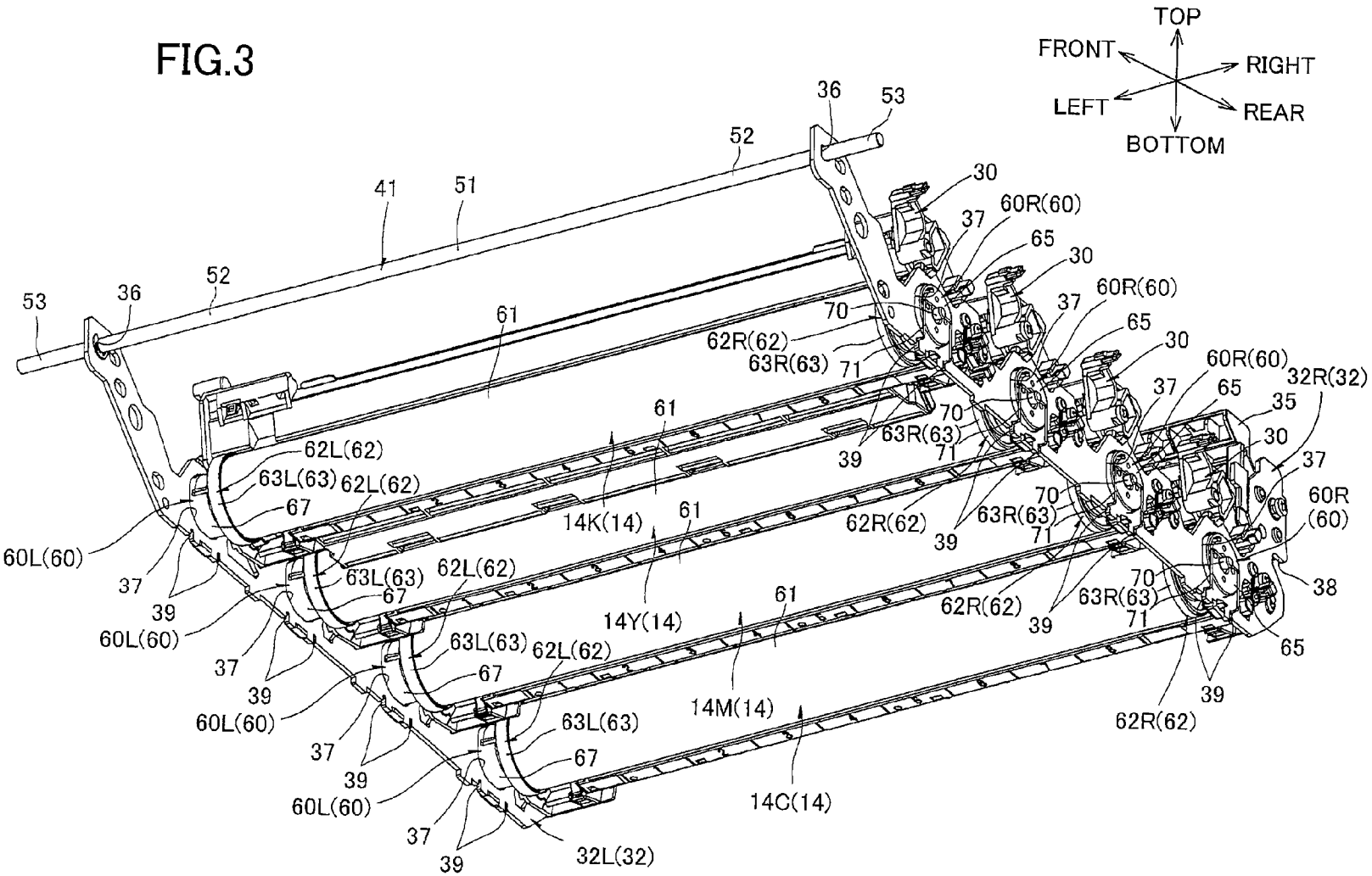
FIG. 3 is a perspective view of the process frame shown in FIG. 2 as viewed from a lower front side, from which a pair of outer side plates and a front beam are omitted.
Figure 5:
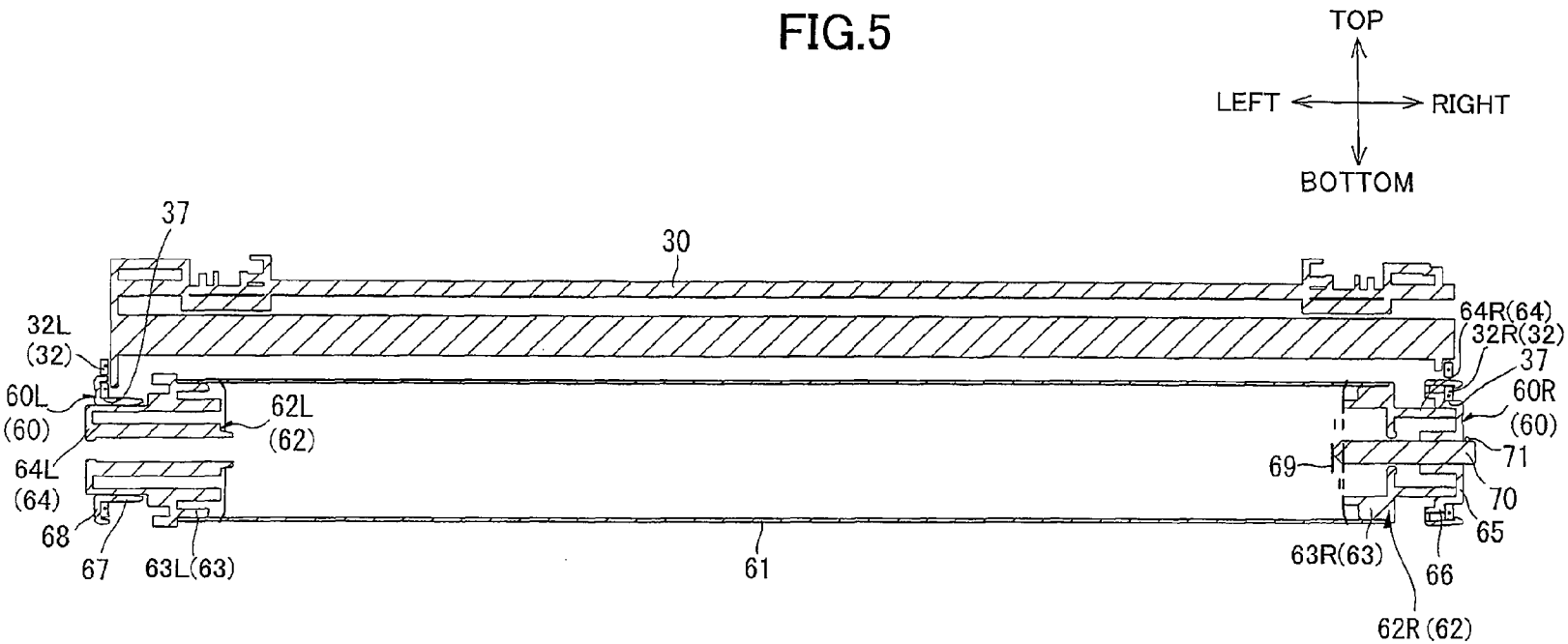
FIG. 5 is a cross-sectional view of a photosensitive drum supported to the process frame shown in FIG. 2.

As shown in FIGS. 2 and 3, the process frame 12 includes a frame body 31, the four photosensitive drums 14, and four drum sub-units 30 (FIG. 5).

(1) Frame Body

The frame body 31 includes a pair of inner side plates 32, a pair of outer side plates 33, a front beam 34, and a rear beam 35.

(1-1) Inner Side Plate

As shown in FIG. 3, the pair of inner side plates 32 is disposed in confrontation with and spaced apart from each other in the right-to-left direction. Hereinafter, the inner side plate 32 at a right side will be referred to as the right inner side plate 32R, and the inner side plate 32 at a left side will be referred to as the left inner side plate 32L, when it is necessary to distinguish between the two. The right and left inner side plates 32R, 32L are respectively made of an electrically conductive material, such as metal, and press-formed by using a same die. Each inner side plate 32 is formed in a generally rectangular shape extending in the front-to-rear direction. Each inner side plate 32 has a front end portion extending diagonally above and frontward, and a rear end portion formed in a generally L-shape extending diagonally above and rearward and further extending upward.

The front end portion of each inner side plate 32 is formed with a hole 36 for allowing a support shaft 41 (described later) extending therethrough. The rear end portion of each inner side plate 32 is formed with a generally V-shaped notch 38 having a rear open side. Four drum support holes 37 are formed in each inner side plate 32 at positions between the hole 36 and the notch 38.

The hole 36 penetrates the front end portion of the inner side plate 32. The support shaft 41 (described later) extends through the hole 36. The notch 38 is formed by notching a rear edge of the inner side plate 32 so as to be depressed frontward. The notch 38 receives a reference shaft 83 (FIG. 6, described later) when the process unit 9 is accommodated in the main casing 2. The four drum support holes 37 are aligned at constant intervals in the front-to-rear direction. Each drum support hole 37 has a generally circular shape.

Each inner side plate 32 is formed with four sets of a pair of grooves 39 at a lower edge thereof. Each set of the pair of grooves 39 is provided at a position below the drum support hole 37. Each groove 39 is notched upward from the lower edge of the inner side plate 32 so as to have a lower open side.

(1-2) Outer Side Plate

As shown in FIG. 2, each of the pair of the outer side plates 33 is formed in a generally rectangular shape having a height in an upper-to-lower direction greater than that of the inner side plate 32, and a length in the front-to-rear direction substantially equal to that of the inner side plate 32. The pair of the outer side plates 33 is disposed in confrontation with and spaced apart from each other in the right-to-left direction. Hereinafter, the outer side plate 33 at a right side will be referred to as the right outer side plate 33R, and the outer side plate 33 at a left side will be referred to as the left outer side plate 33L, when it is necessary to distinguish between the two. The right outer side plate 33R is arranged to cover an outer (right) surface of the right inner side plate 32R. The left outer side plate 33L is arranged to cover an outer (left) surface of the left inner side plate 32L.

Each of the outer side plates 33 is made of electrically-insulating resin. Each outer side plate 33 has a rear end portion formed with a notch 40 having a shape the same as that of the notch 38 at a position confronting the notch 38 in the right-to-left direction. The notch 40 does not interfere with the reference shaft 83 (described later) when the process unit 9 has been accommodated in the main casing 2.

Further, each outer side plate 33 includes a guide rail 46 and a collar 47. The guide rail 46 extends in the front-to-rear direction at an upper edge of the outer side plate 33, and protrudes outward in the right-to-left direction from an outer surface of the outer side plate 33. The guide rail 46 has a length in the front-to-rear direction substantially equal to that of the outer side plate 33.

The collar 47 is rotatably provided at the outer surface of the outer side plate 33 at a position below a rear end portion of the guide rail 46.

(1-3) Front Beam and Rear Beam

Figure 4:
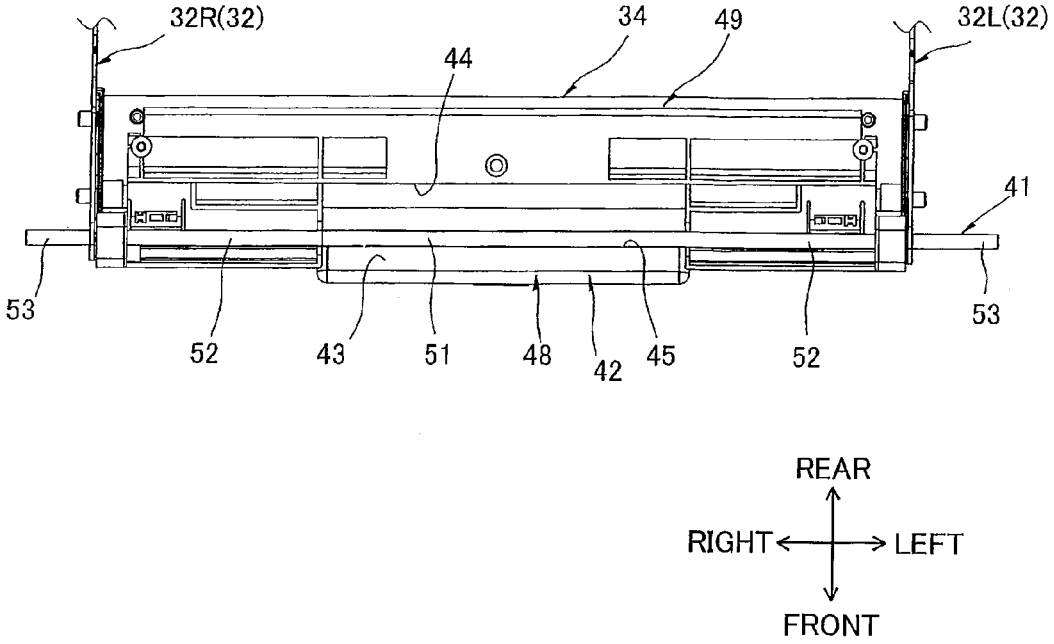
FIG. 4 is a bottom view of the front beam shown in FIG. 2.
Figure 6:
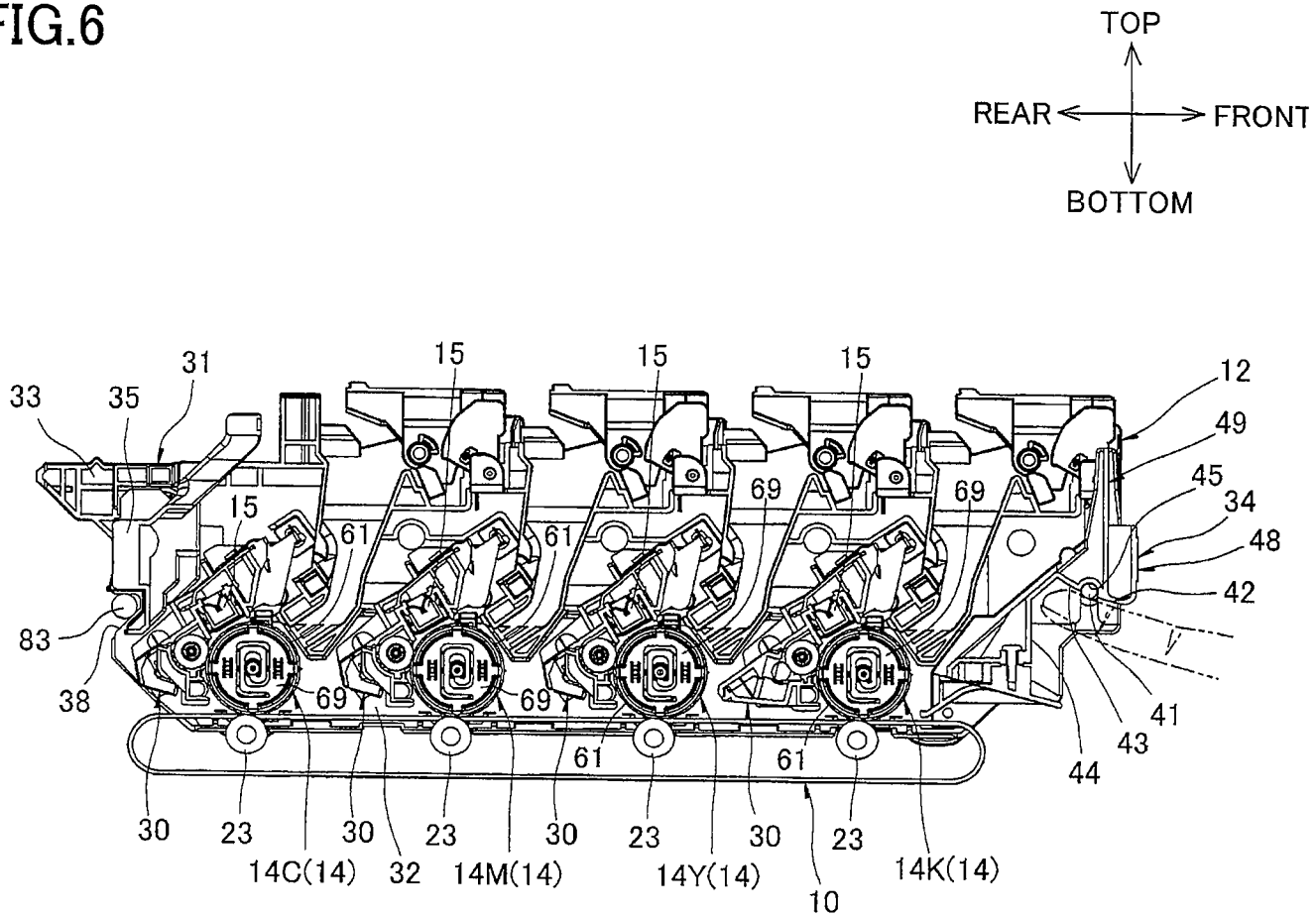
FIG. 6 is a cross-sectional view showing a state that the process frame is in a mounting position.

As shown in FIGS. 4 and 6, the front beam 34 spans between front edges of the inner side plates 32. The front beam 34 includes a beam member 49 made of electrically insulating material, and the support shaft 41 made of metal and extending through the beam member 49.

Further, the front beam 34 is provided with a handle 42 at a center portion thereof in the right-to-left direction.

The handle 42 includes an insulation handle portion 48 disposed at a center portion of the beam member 49 in the right-to-left direction, and a contact portion 51 disposed at a center portion of the support shaft 41 in the right-to-left direction. The insulation handle portion 48 is made of an electrical insulating material.

The insulation handle portion 48 is formed in a generally V-shape, opening in a direction diagonally below and frontward, so as to be depressed diagonally above and rearward from a lower front edge of the front beam 34.

More specifically, the insulation handle portion 48 includes a first wall 43 and a second wall 44. The first wall 43 extends diagonally above and rearward from a substantially center portion in the upper-to-lower direction of the front edge of the front beam 34. The second wall 44 is bent rearward and downward from a rear edge of the first wall 43, and further bent downward to extend in the upper-to-lower direction. The first wall 43 and the second wall 44 are arranged in confrontation with each other substantially in the front-to-rear direction. The first wall 43 is disposed downstream than the second wall 44 in a direction in which the supporting member is drawn.

Further, the first wall 43 has a substantially center portion in the front-to-rear direction formed with a recessed portion 45. The recessed portion 45 is formed in a generally U-shape with an open bottom.

The recessed portion 45 is depressed upward from a lower surface of the first wall 43 and has a length in the right-to-left direction equal to that of the first wall 43. Further, the recessed portion 45 has a depth in the upper-to-lower direction smaller than a diameter of the support shaft 41.

The support shaft 41 extends through the front beam 34 in the right-to-left direction so that a portion of the support shaft 41 is fitted into the recessed portion 45.

The portion of the support shaft 41 fitted into the recessed portion 45 has a lower edge that is slightly exposed beneath the first wall 43 through a lower edge of the recessed portion 45. The support shaft 41 has right and left end portions, each protruding outward in the right-to-left direction from the front beam 34, passing through the hole 36 of the inner side plate 32, and penetrating the outer side plate 33 to further protrude outward in the right-to-left direction. Each of the right and left end portions of the support shaft 41 has an outer circumferential surface that is in contact with an inner circumferential surface of the hole 36. With this configuration, the support shaft 41 is electrically connected to the inner side plates 32.

As shown in FIG. 4, the support shaft 41 has a center portion in the right-to-left direction that is fitted into the recessed portion 45, serving as the contact portion 51. The support shaft 41 has right and left end portions protruding outward in the right-to-left direction from the outer side plates 33, each serving as a positioning portion 53. The support shaft 41 has portions between the contact portion 51 and the positioning portions 53, each serving as a connecting portion 52. That is, the contact portion 51, the connecting portions 52, and the positioning portions 53 constituting the support shaft 41 are integrally formed. The contact portion 51 is electrically connected to each inner side plate 32 through each connecting portion 52 and each positioning portion 53.

The rear beam 35 spans between the rear edges of the inner side plates 32.

(2) Photosensitive Drum

As shown in FIG. 5, the photosensitive drum 14 includes a drum body 61, a pair of flange members 62, and a pair of receiving members 60.

(2-1) Drum Body and Flange Member

The drum body 61 is formed in a generally cylindrical shape extending in the right-to-left direction. The drum body 61 has right and left open ends fitted with the flange members 62. The flange members 62 are not rotatable relative to the drum body 61. Each of the flange members 62 has a first engagement portion 63 that is inserted into the drum body 61 and a second engagement portion 64 that is supported to the receiving member 60.

Hereinafter, the flange member 62 fitted in the right open end of the drum body 61 will be referred to as the right flange member 62R, and the flange member 62 fitted in the left open end of the drum body 61 will be referred to as the left flange member 62L, when it is necessary to distinguish between the two. Further, the first engagement portion 63 provided in the right flange member 62R will be referred to as the right first engagement portion 63R, and the first engagement portion 63 provided in the left flange member 62L will be referred to as the left first engagement portion 63L, when it is necessary to distinguish between the two. Likewise, the second engagement portion 64 provided in the right flange member 62R will be referred to as the right second engagement portion 64R, and the second engagement portion 64 provided in the left flange member 62L will be referred to as the left second engagement portion 64L, when it is necessary to distinguish between the two.

More specifically, the right first engagement portion 63R of the right flange member 62R is formed in a cylindrical shape having an outer diameter substantially equal to an inner diameter of the drum body 61.

Further, the right second engagement portion 64R of the right flange member 62R protrudes rightward from the right first engagement portion 63R so as to be arranged coaxially with the right first engagement portion 63R. The right second engagement portion 64R is formed in a generally cylindrical shape having a right open end. The right second engagement portion 64R has an outer diameter smaller than an inner diameter of the drum support hole 37 formed in the right inner side plate 32R.

The left first engagement portion 63L of the left flange member 62L is formed in a cylindrical shape having an outer diameter substantially equal to the inner diameter of the drum body 61.

The left second engagement portion 64L of the left flange member 62L protrudes leftward from the left first engagement portion 63L so as to be arranged coaxially with the left first engagement portion 63L. The left second engagement portion 64L is formed in a generally cylindrical shape having a left closed end.

The left second engagement portion 64L has an outer diameter substantially equal to the outer diameter of the right second engagement portion 64R.

The left second engagement portion 64L has a left end formed with a coupling engagement hole (not shown) that is engageable with an engagement protrusion (not shown) provided in a male coupling member (not shown) of the main casing 2.

(2-2) Shaft Receiving Member

Each of the receiving members 60 is fixed to each of the inner side plates 32, and rotatably supports each end of the photosensitive drum 14. Hereinafter referred to as the receiving member 60 fixed to the right inner side plate 32 will be referred to as the right receiving member 60R, and the receiving member 60 fixed to the left inner side plate 32 will be referred to as the left receiving member 60L, when it is necessary to distinguish between the two.

More specifically, the right receiving member 60R is integrally provided with a tubular portion 65 and a flange portion 66.

The tubular portion 65 is formed in a generally cylindrical shape extending in the right-to-left direction and having a left open end and a right closed end that is closed by its side wall. The tubular portion 65 has an outer diameter slightly smaller than the inner diameter of the drum support hole 37 formed in the right inner side plate 32R. The tubular portion 65 has an inner diameter slightly greater than the outer diameter of the right second engagement portion 64R so that the right second engagement portion 64R is loosely fitted with the tubular portion 65.

The flange portion 66 is formed in a generally annular shape and protrudes radially outward from the left open end of the tubular portion 65.

The left receiving member 60L is integrally provided with a tubular portion 67 and a flange portion 68. The tubular portion 67 is formed in a generally cylindrical shape extending in the right-to-left direction and having right and left open ends. The tubular portion 67 has an outer diameter slightly smaller than the inner diameter of the drum support hole 37 formed in the left inner side plate 32L. Further, the tubular portion 67 has an inner diameter slightly greater than the outer diameter of the left second engagement portion 64L so that the left second engagement portion 64L is loosely fitted with the tubular portion 67.

The flange portion 68 is formed in a generally annular shape and protrudes radially outward from the left open end of the tubular portion 67.

The tubular portion 65 of the right receiving member 60R is fitted onto the right second engagement portion 64R from a right side. The tubular portion 65 is rotatable relative to the right second engagement portion 64R. Further, the tubular portion 65 is fitted into the drum support hole 37 from a left side. The tubular portion 65 is not rotatable relative to the drum support hole 37.

The tubular portion 67 of the left receiving member 60L is fitted into the drum support hole 37 from a left side so as to be fitted onto the left second engagement portion 64L from a left side. The tubular portion 67 is rotatable relative to the left second engagement portion 64L but not rotatable relative to the drum support hole 37.

With this configuration, each photosensitive drum 14 is rotatably supported to the pair of inner side plates 32.

(2-3) Structure for Grounding of Photosensitive Drum

Inside the drum body 61, a grounding member 69 and a shaft 70 are provided at a right end of the drum body 61.

The grounding member 69 is made of metal, and formed in a generally disk shape. The grounding member 69 is fitted with the drum body 61 at a position on a left side of the right flange member 62R so that a peripheral edge of the grounding member 69 is in contact with an inner peripheral surface of the drum body 61.

The shaft 70 is made of metal. The shaft 70 is arranged so as to be disposed coaxially with the drum body 61. The shaft 70 has a left end that passes through the center of the grounding member 69, thereby being electrically connected to the grounding member 69. Further, the shaft 70 has a right end penetrating through the right flange member 62R and the right receiving member 60R, and then protruding rightward from the right receiving member 60R.

As shown in FIG. 3, a clip 71 is attached to the right end of the shaft 70 protruding rightward from the right receiving member 60R. The clip 71 is formed in a generally U-shape opening downward. The clip 71 is made of metal wire. The clip 71 has an upper portion that is in contact with an upper portion of the shaft 70, and lower free ends that are respectively in engagement with the pair of grooves 39 formed in the right inner side plate 32R.

With this configuration, the drum body 61 is electrically connected and grounded to the right inner side plate 32R via the grounding member 69, the shaft 70, and the clip 71.

(3) Drum Sub-Unit

As shown in FIG. 6, the four drum sub-units 30 are disposed between the pair of inner side plates 32, and between the front beam 34 and the rear beam 35, and juxtaposed with each other in the front-to-rear direction at constant intervals such that each drum sub-unit 30 is disposed rearward of the corresponding photosensitive drum 14.

Each drum sub-unit 30 is formed in a generally triangular prism shape and extends in the right-to-left direction. Each drum sub-unit 30 retains the charger 15 in the right-to-left direction.

3. Detailed Structure of Main Casing

Figure 7:
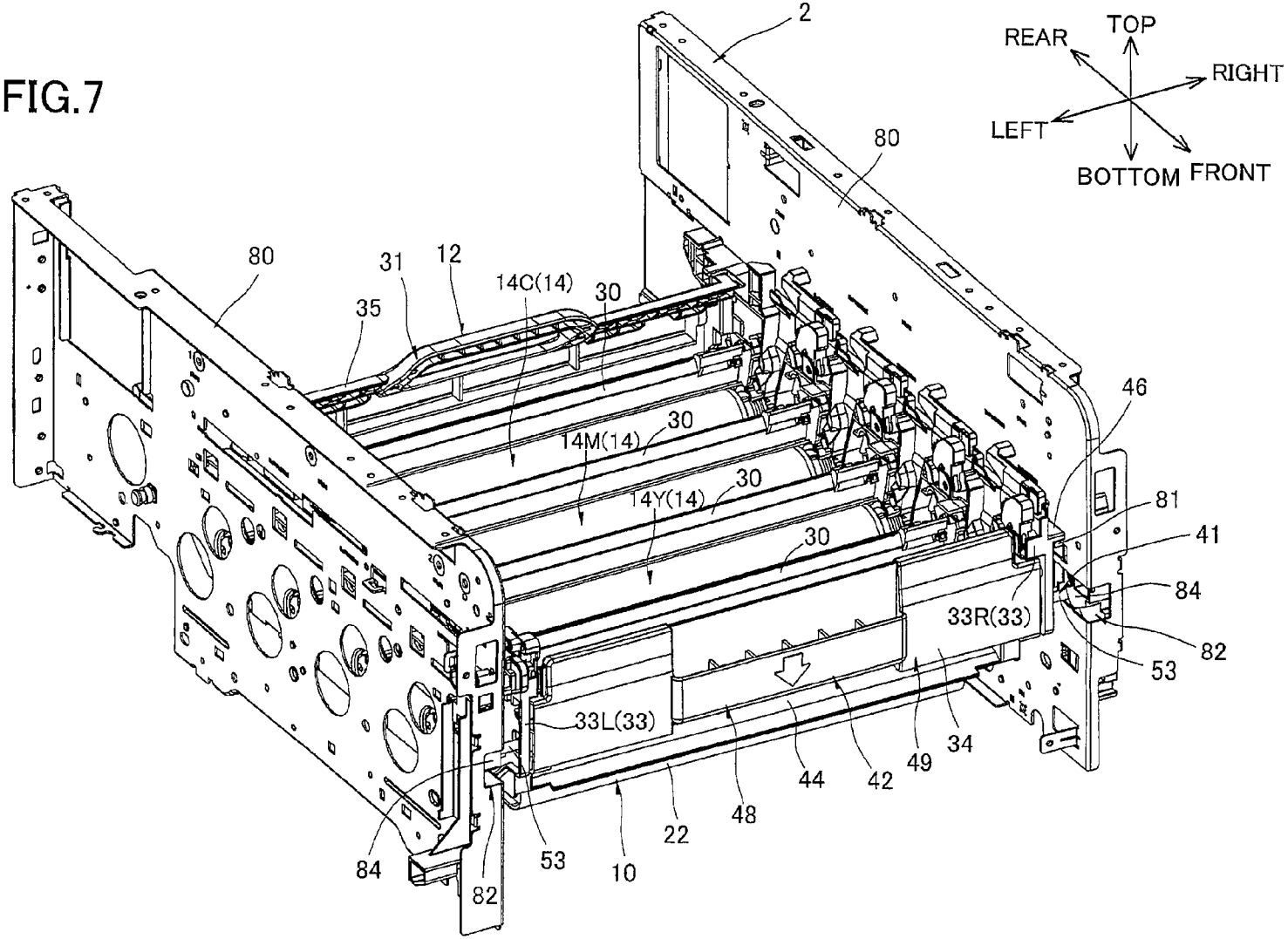
FIG. 7 is a perspective view showing a state that the process frame is in the mounting position as viewed from an upper front side.

As shown in FIG. 7, the main casing 2 has a pair of right and left side walls 80. Further, within the main casing 2, a pair of positioning portions 82, the reference shaft 83 (FIG. 6), and a pair of guide rails 81.

Each of the right and left side walls 80 has a front end portion in which the positioning portion 82 is formed. More specifically, the positioning portion 82 is formed in a substantially center portion in the upper-to-lower direction of the front end portion of each side wall 80. Each positioning portion 82 is a generally rectangular-shaped recess depressed outward in the right-to-left direction from an inner surface of the side wall 80. Each positioning portion 82 is engageable with each positioning portion 53 of the support shaft 41.

Within the positioning portion 82, a lock member 84 for placing the positioning portion 53 of the support shaft 41 in the positioning portion 82 is provided. The lock member 84 is slidingly movable between an upper position and a lower position within the positioning portions 82 in association with movement of the front cover 5 between an open position and a closed position. When the front cover 5 is moved to the open position, the lock member 84 is slidingly moved to the upper position, thereby being capable of receiving the positioning portion 53 of the support shaft 41 from a front side. After having received the positioning portion 53 of the support shaft 41, the lock member 84 is slidingly moved to the lower position in association with the movement of the front cover 5 toward the closed position. As a result, the positioning portion 53 of the support shaft 41 is positionally-fixed in the positioning portion 82 by the lock member 84.

As shown in FIG. 6, the reference shaft 83 spans between the center portions in the upper-to-lower direction of the right and left side walls 80 at a position above and rearward of the transfer unit 10. The reference shaft 83 is an electrically conductive material and is electrically grounded to ground. The reference shaft 83 is electrically connected to the main casing 2.

As shown in FIG. 7, each guide rail 81 is a protrusion provided at a substantially center portion in the upper-to-lower direction of the side wall 80, and extends in the front-to-rear direction between the positioning portion 82 and the reference shaft 83. When the process unit 9 is accommodated in the main casing 2, each guide rail 81 supports each collar 47 from below. Although it is not shown, each guide rail 81 has a rear end that is bent diagonally below and rearward.

Figure 8:
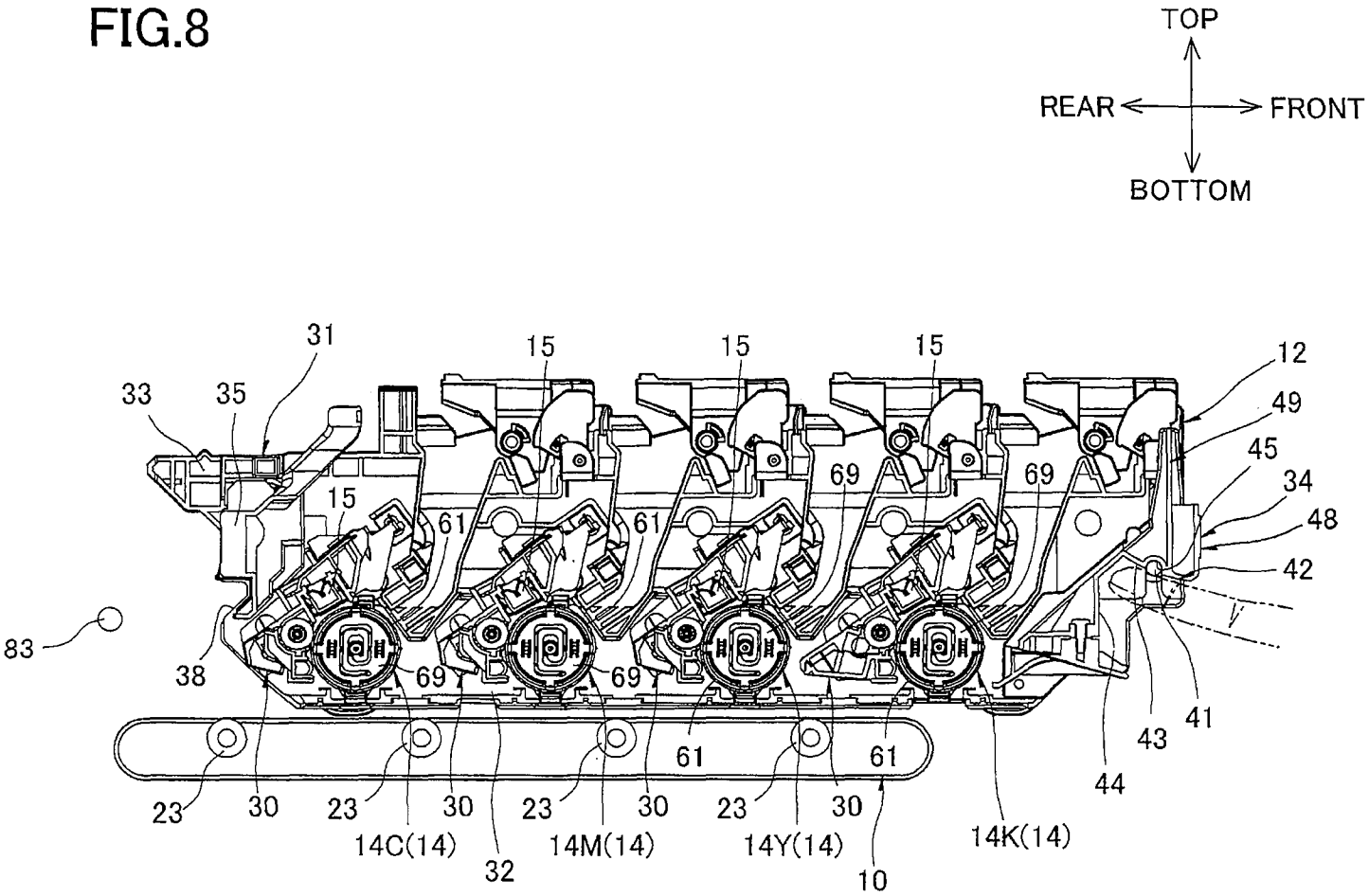
FIG. 8 is a cross-sectional view showing a state that the process frame is being drawn toward a drawn-out position.
Figure 9:
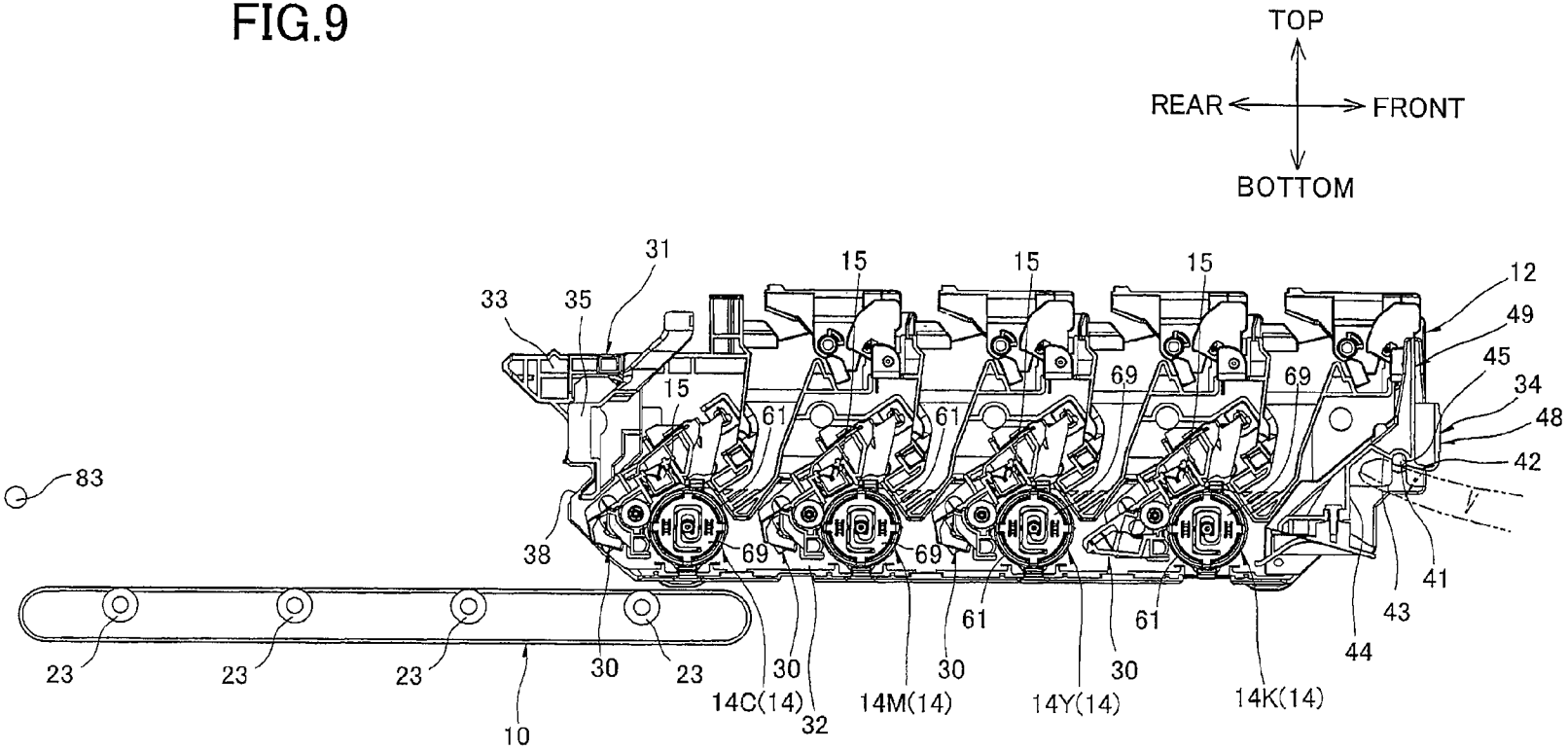
FIG. 9 is a cross-sectional view showing a state that the process frame is in the drawn-out position.

With this configuration, when the process unit 9 is slidingly moved to the drawn-out position from the mounting position, each of the guide rails 81 guides the process unit 9 from the mounting position upward and frontward (FIG. 8), and then, frontward (FIG. 9). When the process unit 9 is slidingly moved to the mounting position from the drawn-out position, each of the guide rails 81 guides the process unit 9 from the drawn-out position rearward (FIG. 9), and then, downward and rearward (FIG. 8).

4. Grounding of Process Frame

When the process frame 12 is positioned in the mounting position within the main casing 2, as shown in FIG. 6, the reference shaft 83 is in abutment with the notches 38 formed in the inner side plates 32, so that a rear end portion of the process frame 12 can be positioned relative to the main casing 2. Further, as shown in FIG. 7 and as described above, each positioning portion 53 of the support shaft 41 is positionally-fixed in each positioning portion 82 by the lock member 84, so that a front end portion of the process frame 12 can be positioned relative to the main casing 2. Further, each photosensitive drum 14 is in contact with the top portion of the conveying belt 22.

At this time, each inner side plate 32 is in contact with the reference shaft 83, because the reference shaft 83 is in contact with the notches 38 formed in the inner side plates 32. Through the reference shaft 83, each inner side plate 32 is electrically connected to the main casing 2. With this configuration, the process frame 12 is electrically grounded through the main casing 2.

As described above, each photosensitive drum 14 is electrically grounded to the right inner side plate 32R through the grounding member 69, the shaft 70, and the clip 71.

5. Sliding Movement of Process Frame

Next, a sliding movement of the process frame 12 will be described while referring to FIGS. 6, 8, and 9.

When the process frame 12 is slidingly moved to the drawn-out position from the mounting position, a user holds the handle 42, as shown in FIG. 6. At this time, a finger of the user is placed onto the first wall 43 of the insulation handle portion 48 and brought into contact with the contact portion 51 of the support shaft 41. As a result, the user's finger is electrically connected to the process frame 12 via the support shaft 41. Hence, the user's finger has an electric potential substantially the same as that of the process frame 12.

Subsequently, in order to slidingly move the process frame 12 to the drawn-out position from the mounting position, the user pulls the process frame 12 toward a direction diagonally above and frontward.

Then, as shown in FIG. 8, the process frame 12 is guided by the pair of guide rails 81 from the mounting position toward the direction diagonally above and frontward, and the notches 38 formed in the inner side plates 32 are moved away from the reference shaft 83. As a result, the process frame 12 becomes ungrounded. In other words, the inner side plate 32 is electrically disconnected from the reference shaft 83 while the process frame 12 is moving from the mounting position to the drawn-out position. Each photosensitive drum 14 is moved upward to be separated from the top portion of the conveying belt 22.

Then, the user pulls the process frame 12 frontward, as shown in FIG. 9, the process frame 12 is guided by the pair of guide rails 81 to be moved frontward, and positioned at the drawn-out position. Thus, the sliding movement of the process frame 12 from the mounting position to the drawn-out position is completed. The side plates 32 are electrically disconnected from the reference shaft 83 when the process unit 12 is disposed at the drawn-out position.

If electric charge remains in the conveying belt 22 or the transfer rollers 23 when the process frame 12 is slidingly moved to the drawn-out position from the mounting position, each photosensitive drum 14 separated from the conveying belt 22 may be electrostatically charged due to the electric charge remaining in the conveying belt 22 or the transfer rollers 23. Because the process frame 12 is not grounded, the electric charge accumulated in the photosensitive drum 14 is attracted to the process frame 12. Hence, the electric charge is accumulated in the process frame 12.

However, since the user's finger has an electric potential substantially the same as that of the process frame 12 when the user holds the handle 42, the electric charge accumulated in the process frame 12 is restrained from being discharged between the user's finger and the process frame 12.

In order to slidingly move the process frame 12 to the mounting position from the drawn-out position, the user pushes rearward the process frame 12 at the drawn-out position.

Then, the process frame 12 is guided by the pair of guide rails 81 to be moved rearward, and then, toward a direction diagonally below and rearward. As a result, the process frame 12 is positioned at the mounting position.

6. Operations and Effects (1) According to the color laser printer 1 in the above described embodiment, as shown in FIGS. 3 and 4, the process frame 12 for integrally supporting the photosensitive drums 14 rotatably supports right and left end portions of each photosensitive drum 14. Further, the process frame 12 includes the pair of metal inner side plates 32 that is electrically connected to the photosensitive drums 14. When the process frame 12 is in the mounting position, the process frame 12 is electrically grounded via the main casing 2.

Further, the process frame 12 includes the support shaft 41 (the contact portion 51 and the connecting portions 52) that is made of metal and electrically connected to the pair of inner side plates 32. When the process frame 12 is moved to the drawn-out position from the mounting position, a finger of the user contacts the support shaft 41 (the contact portion 51).

When the process frame 12 is slidingly moved to the drawn-out position from the mounting position, the user's finger is brought into contact with the contact portion 51 of the support shaft 41 at the mounting position of the process frame 12. At this time, the user's finger is grounded to the main casing 2 through the connecting portions 52 and the inner side plates 32. Hence, the user's finger has an electric potential substantially the same as that of the process frame 12. In other words, a difference in electric potential between the user's finger and the process frame 12 can be reduced.

Then, as the user slidingly moves the process frame 12 to the drawn-out position from the mounting position, the process frame 12 is drawn-out and positioned in the drawn-out position while the electric potential of the user's finger is substantially the same as that of the process frame 12.

As a result, electrostatic discharge between the process frame 12 and the user's finger can be restrained.

(2) Further, according to the color laser printer 1 in the above-described embodiment, as shown in FIG. 4, the contact portion 51 is provided in the handle 42 held by the user when the process frame 12 is slidingly moved to the drawn-out position from the mounting position.

Therefore, when slidingly moving the process frame 12 to the drawn-out position from the mounting position, the user can reliably contact the contact portion 51.

(3) Further, according to the color laser printer 1 in the above-described embodiment, as shown in FIG. 6, the contact portion 51 is disposed at the first wall 43 disposed at a front portion of the insulation handle portion 48.

Since the user's finger is placed onto the first wall 43 when the user slidingly moves the process frame 12 to the drawn-out position from the mounting position, the user can more reliably contact the contact portion 51 disposed at the first wall 43 when slidingly moving the process frame 12 to the drawn-out position from the mounting position.

(4) Further, according to the color laser printer 1 in the above described embodiment, as shown in FIGS. 4 and 7, each positioning portion 53 of the support shaft 41 protrudes outward in the right-to-left direction from each inner side plate 32.

Due to such configuration, the user may unintentionally contact one of the positioning portions 53 while slidingly moving the process frame 12.

However, the support shaft 41 is electrically connected to the inner side plates 32. Therefore, even if the user contacts either one of the positioning portions 53 while slidingly moving the process frame 12, electrostatic discharge between the process frame 12 and the user can be restrained.

(5) Further, according to the color laser printer 1 in the above-described embodiment, as shown in FIG. 4, each positioning portion 53 is connected to each connecting portion 52. With this configuration, each positioning portion 53 can be reliably electrically connected to each inner side plate 32 via each connecting portion 52.

(6) Further, according to the color laser printer 1 in the above-described embodiment, as shown in FIG. 4, the support shaft 41 is integrally provided with the contact portion 51, the connecting portions 52, and the positioning portions 53. Therefore, with a simple configuration, the contact portion 51, the connecting portions 52, and the positioning portions 53 are electrically connected one another.

(7) Further, according to the color laser printer 1 in the above-described embodiment, as shown in FIG. 2, the process frame 12 includes the pair of outer side plates 33 made of electrically-insulating resin. Each outer side plate 33 covers the outer surface of each inner side plate 32. Accordingly, this configuration protects each inner side plate 32 from direct contact with the user or other parts and components provided within the main casing 2.

(8) Further, according to the color laser printer 1 in the above-described embodiment, as shown in FIG. 4, each connecting portion 52 electrically connects the contact portion 51 to each inner side plate 32. Accordingly, a difference in electric potential between the user's finger and the process frame 12 can be further reduced. Hence, electrostatic discharge between the process frame 12 and the user's finger can be further restrained.

7. Modifications

While the present invention has been described in detail with reference to the embodiment thereof, it would be apparent to those skilled in the art that various changes and modifications may be made therein without departing from the spirit of the invention.

According to the above-described embodiment, in the handle 42, the recessed portion 45 is formed in the first wall 43 of the insulation handle portion 48. Further, the support shaft 41 spans between the right and left inner side plates 32R, 32L so that the lower edge of the support shaft 41 is slightly exposed beneath the first wall 43 through the lower edge of the recessed portion 45. With this configuration, the user's finger is electrically connectable to the inner side plates 32 through the contact portion 51 (i.e. a portion of the support shaft 41 fitted into the recessed portion 45).

Figure 10:
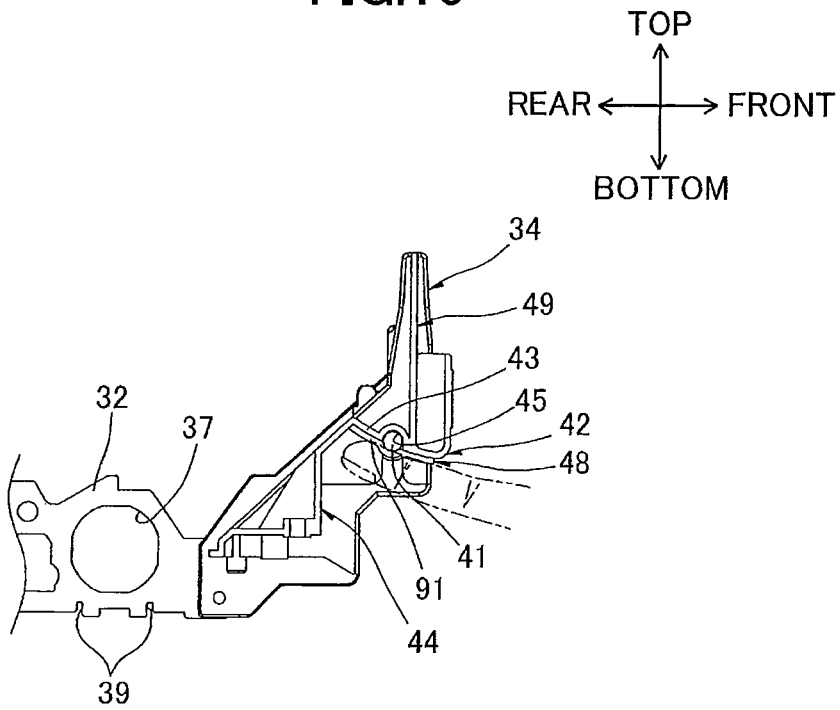
FIG. 10 is a cross-sectional view of a front beam of a process frame provided in a color laser printer according to one modification of the present invention.

However, the structure for establishing electrical connection between the user's finger and the inner side plates 32 is not limited to the above-described embodiment. For example, as shown in FIG. 10, an electrically-conductive sheet 91 as a contact portion formed of electrically conductive resin may be provided at the first wall 43 so as to be in contact with the portion of the support shaft 41 fitted into the recessed portion 45. In other words, the handle 42 includes the electrically-conductive sheet 91 made of electrically conductive material.

In this modification, when the user holds the handle 42, a finger of the user contacts the electrically-conductive sheet 91. The user's finger is electrically connected to the inner side plates 32 through the electrically-conductive sheet 91 and the support shaft 41.

According to this modification, as shown in FIG. 10, the electrically-conductive sheet 91 is provided in the handle 42 which is held by the user when the user slidingly moves the process frame 12 to the drawn-out position from the accommodating position.

Accordingly, when slidingly moving the process frame 12 to the drawn-out position from the mounting position, the user can reliably contact the electrically-conductive sheet 91.

Further, the handle 42 can be made of the electrically conductive material.

In the above-described embodiment, the color laser printer 1 is a direct tandem-type color laser printer. A toner image carried on each photosensitive drum 14 is sequentially transferred onto a sheet conveyed by the conveying belt 22.

However, the color laser printer 1 may include an intermediate transfer belt as an endless belt onto which a toner image carried on each photosensitive drum 14 (primary transfer) is to be transferred, and a secondary transfer roller. The color laser printer 1 may be configured such that a toner image transferred onto the intermediate transfer belt is transferred onto a sheet by the secondary transfer roller (secondary transfer).

In the above-described embodiment, the process frame 12 is slidably movable in the front-to-rear direction in which the photosensitive drums 14 are juxtaposed. However, the process frame 12 may be slidably movable in the upper-to-lower direction that is perpendicular to the front-to-rear direction.

In the above-described embodiment, each photosensitive drum 14 is rotatably supported to the process frame 12. However, in order for the photosensitive drums 14 to be supported to the process frame 12, for example, the process frame 12 may include a drum unit for rotatably supporting each photosensitive drum 14, and the drum unit may be supported to the process frame 12.

Further, in the above-described embodiment, the process frame 12 is electrically grounded through the main casing 2. However, the process frame 12 needs not be electrically connected and grounded to the main casing 2. In this case, the process frame 12 can be connected to a grounding member that is electrically grounded to the ground instead of the reference shaft 83.

In the above described embodiment, when the process frame 12 is in the mounting position, both of the pair of metal inner side plates 32 of the process frame 12 is electrically grounded to the main casing 2 via the both two of connecting portions 52. However, one of the pair of side plates 32 may be electrically connected to the main casing 2 and other of the pair of the side plates 32 may be electrically disconnected to the main casing 2, when the process frame is in the mounting position. In other words, at least one of the pair of side plates may be electrically connected to the main body when the supporting member is disposed at the mounting position.

Further, one of the pair of side plates 32 may support a prescribed portion of a photosensitive drum 14, the prescribed portion different from the two ends.

What is claimed is:

1. An image forming device comprising:

a main body;

a grounding member that is electrically grounded; and a supporting member slidably movable between a mounting position and a drawn-out position with respect to the main body, the supporting member including:

a plurality of photosensitive drums juxtaposed with and spaced apart from each other, each of the plurality of photosensitive drums extending in an axial direction and having two ends in the axial direction;

a pair of side plates spaced apart from each other, the pair of side plates being made of an electrically conductive material, the pair of side plates supporting the two ends of each of the plurality of photosensitive drums, at least one of the pair of side plates being electrically connected to the grounding member when the supporting member is disposed at the mounting position;

a contact portion configured to be contacted by a user when the user draws the supporting member to move from the mounting position to the drawn-out position, the contact portion being made of an electrically conductive material; and a connecting portion via which the contact portion and the at least one of the pair of side plates are electrically connected with each other, the connecting portion being made of an electrically conductive material, wherein the main body includes an endless belt configured to contact the plurality of photosensitive drums, wherein the plurality of photosensitive drums contact the endless belt when the supporting member is disposed at the mounting position and separate from the endless belt when the supporting member is disposed at the drawn-out position, and wherein the at least one of the pair of side plates is electrically disconnected from the grounding member while the supporting member is moving from the mounting position to the drawn-out position.

2. The image forming device according to claim 1, wherein the grounding member is fixed and electrically connected to the main body.

3. The image forming device according to claim 1, wherein the at least one of the pair of side plates is electrically disconnected from the grounding member when the supporting member is disposed at the drawn-out position.

4. The image forming device according to claim 1, wherein the supporting member further includes a handle configured to be held by the user when the user draws the supporting member to move from the mounting position to the drawn-out position, the handle being made of an electrical insulating material, the contact portion being provided on the handle.

5. The image forming device according to claim 4, wherein the handle includes a first portion and a second portion that is disposed further downstream than the first portion in a direction in which the supporting member is drawn, and wherein the contact portion is disposed on the second portion.

6. The image forming device according to claim 1, wherein the supporting member further includes a handle configured to be held by the user when the user draws the supporting member to move from the mounting position to the drawn-out position, the handle being made of an electrically conductive material, the contact portion being provided on the handle.

7. The image forming device according to claim 1, further comprising a positioning portion configured to position the supporting member to the mounting position, the positioning portion being made of an electrically conductive material, wherein the positioning portion is electrically connected to the at least one of the pair of the side plates.

8. The image forming device according to claim 7, wherein the positioning portion is integrally provided on the at least one of the pair of side plates.

9. The image forming device according to claim 8, wherein the positioning portion protrudes outward from the at least one of the pair of side plates in the axial direction.

10. The image forming device according to claim 8, wherein the supporting member is integrally provided with the contact portion, the connecting portion, and the positioning portion.

11. The image forming device according to claim 9, wherein the supporting member includes a shaft on which the contact portion, the connecting portion, and the positioning portion are integrally formed.

12. The image forming device according to claim 1, wherein the at least one of the pair of side plates has an outer surface, and wherein the supporting member further includes a covering plate configured to cover the outer surface of the at least one of the pair of side plates, the covering plate being made of an electrical insulating material.

13. The image forming device according to claim 1, wherein the pair of side plates is electrically connected to the grounding member when the supporting member is disposed at the mounting position.

14. An image forming device comprising:

a main body;

a grounding member that is electrically grounded; and a supporting member slidably movable between a mounting position and a drawn-out position with respect to the main body, the supporting member including:

a plurality of photosensitive drums juxtaposed with and spaced apart from each other, each of the plurality of photosensitive drums extending in an axial direction and having two ends in the axial direction;

a pair of side plates spaced apart from each other, the pair of side plates being made of an electrically conductive material, the pair of side plates supporting the two ends of each of the plurality of photosensitive drums, at least one of the pair of side plates being electrically connected to the grounding member when the supporting member is disposed at the mounting position;

a contact portion configured to be contacted by a user when the user draws the supporting member to move from the mounting position to the drawn-out position, the contact portion being made of an electrically conductive material; and a connecting portion via which the contact portion and the at least one of the pair of side plates are electrically connected with each other, the connecting portion being made of an electrically conductive material, wherein the at least one of the pair of side plates is electrically disconnected from the grounding member when the supporting member is disposed at the drawn-out position.

15. The image forming device according to claim 14, wherein the grounding member is fixed and electrically connected to the main body.

16. The image forming device according to claim 15, wherein the supporting member further includes a handle configured to be held by the user when the user draws the supporting member to move from the mounting position to drawn-out position, the handle being made of an electrical insulating material, the contact portion being provided on the handle.

17. The image forming device according to claim 16, wherein the handle includes a first portion and a second portion that is disposed further downstream than the first portion in a direction in which the supporting member is drawn, and wherein the contact portion is disposed on the second portion.

18. The image forming device according to claim 16, wherein the supporting member further includes a handle configured to be held by the user when the user draws the supporting member to move from the mounting position to the drawn-out position, the handle being made of an electrically conductive material, the contact portion being provided on the handle.

19. The image forming device according to claim 17, further comprising a positioning portion configured to position the supporting member to the mounting position, the positioning portion being made of an electrically conductive material, wherein the positioning portion is electrically connected to the at least one of the pair of the side plates.

20. The image forming device according to claim 19, wherein the positioning portion is integrally provided on the at least one of the pair of side plates.

21. The image forming device according to claim 20, wherein the positioning portion protrudes outward from the at least one of the pair of side plates in the axial direction.

22. The image forming device according to claim 19, wherein the supporting member is integrally provided with the contact portion, the connecting portion, and the positioning portion.

23. The image forming device according to claim 19, wherein the supporting member includes a shaft on which the contact portion, the connecting portion, and the positioning portion are integrally formed.

24. The image forming device according to claim 18, wherein the at least one of the pair of side plates has an outer surface, and wherein the supporting member further includes a covering plate configured to cover the outer surface of the at least one of the pair of side plates, the covering plate being made of an electrical insulating material.

25. The image forming device according to claim 19, wherein the pair of side plates is electrically connected to the grounding member when the supporting member is disposed at the mounting position.

26. An image forming device comprising:

a main body;

a grounding member that is electrically grounded; and a supporting member slidably movable between a mounting position and a drawn-out position with respect to the main body, the supporting member including:

a plurality of photosensitive drums juxtaposed with and spaced apart from each other, each of the plurality of photosensitive drums extending in an axial direction and having two ends in the axial direction;

a pair of side plates spaced apart from each other, the pair of side plates being made of an electrically conductive material, the pair of side plates supporting the two ends of each of the plurality of photosensitive drums, at least one of the pair of side plates being electrically connected to the grounding member when the supporting member is disposed at the mounting position;

a contact portion configured to be contacted by a user when the user draws the supporting member to move from the mounting position to the drawn-out position, the contact portion being made of an electrically conductive material; and a connecting portion via which the contact portion and the at least one of the pair of side plates are electrically connected with each other, the connecting portion being made of an electrically conductive material, wherein the supporting member further includes a handle configured to be held by the user when the user draws the supporting member to move from the mounting position to the drawn-out position, the handle being made of an electrically conductive material, the contact portion being provided on the handle.

27. The image forming device according to claim 26, wherein the grounding member is fixed and electrically connected to the main body.

28. The image forming device according to claim 26, further comprising a positioning portion configured to position the supporting member to the mounting position, the positioning portion being made of an electrically conductive material, wherein the positioning portion is electrically connected to the at least one of the pair of the side plates.

29. The image forming device according to claim 28, wherein the positioning portion is integrally provided on the at least one of the pair of side plates.

30. The image forming device according to claim 29, wherein the positioning portion protrudes outward from the at least one of the pair of side plates in the axial direction.

31. The image forming device according to claim 28, wherein the supporting member is integrally provided with the contact portion, the connecting portion, and the positioning portion.

32. The image forming device according to claim 28, wherein the supporting member includes a shaft on which the contact portion, the connecting portion, and the positioning portion are integrally formed.

33. The image forming device according to claim 26, wherein the at least one of the pair of side plates has an outer surface, and wherein the supporting member further includes a covering plate configured to cover the outer surface of the at least one of the pair of side plates, the covering plate being made of an electrical insulating material.

34. The image forming device according to claim 26, wherein the pair of side plates is electrically connected to the grounding member when the supporting member is disposed at the mounting position.

* * * * *